United States Patent [19]

Anderson

[11] Patent Number: 5,027,483

[45] Date of Patent: Jul. 2, 1991

[54] APPARATUS FOR SELECTIVELY RELEASING YARNS FROM A FRINGE

[75] Inventor: Larry D. Anderson, Appleton, Wis.

[73] Assignee: Asten Group, Inc., Charleston, S.C.

[21] Appl. No.: 472,734

[22] Filed: Jan. 31, 1990

[51] Int. Cl.[5] ..... D03J 1/14

[52] U.S. Cl. ..... 28/141

[58] Field of Search ..... 28/141; 139/1 R, 11, 139/59

[56] References Cited

U.S. PATENT DOCUMENTS

| | | | |
|---|---|---|---|
| 4,410,015 | 10/1983 | Koller et al. | 28/141 X |
| 4,557,025 | 12/1985 | Eglin | 28/141 |
| 4,581,794 | 4/1986 | Oldroyd et al. | 28/141 |

*Primary Examiner*—Werner H. Schroeder
*Assistant Examiner*—John J. Calvert
*Attorney, Agent, or Firm*—Volpe and Koenig

[57] ABSTRACT

An apparatus for use in seaming flat woven fabrics is disclosed. The apparatus utilizes a shed formation means to unweave yarns from a yarn fringe and presents them for interweaving in the seam area.

31 Claims, 6 Drawing Sheets

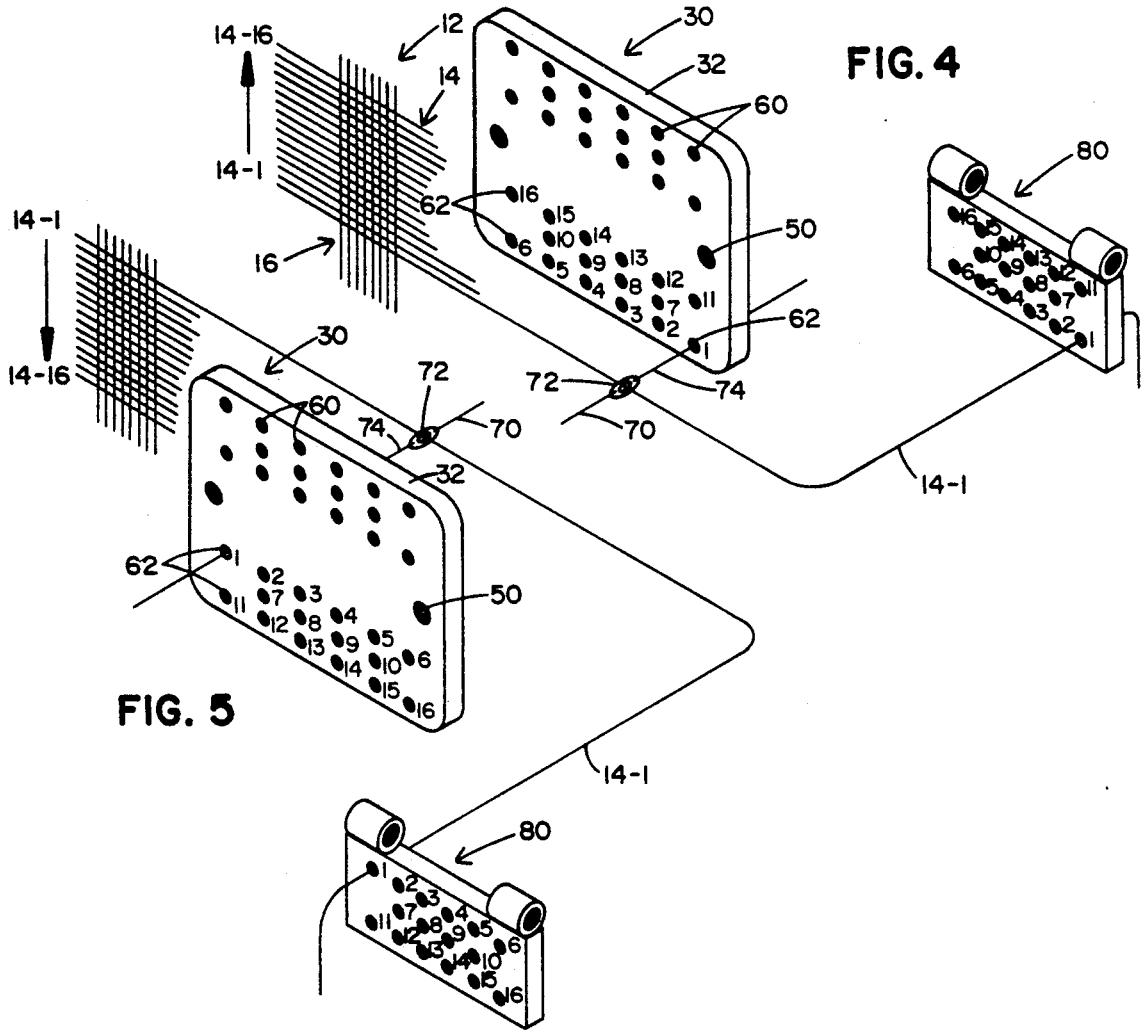
FIG. 4
FIG. 5
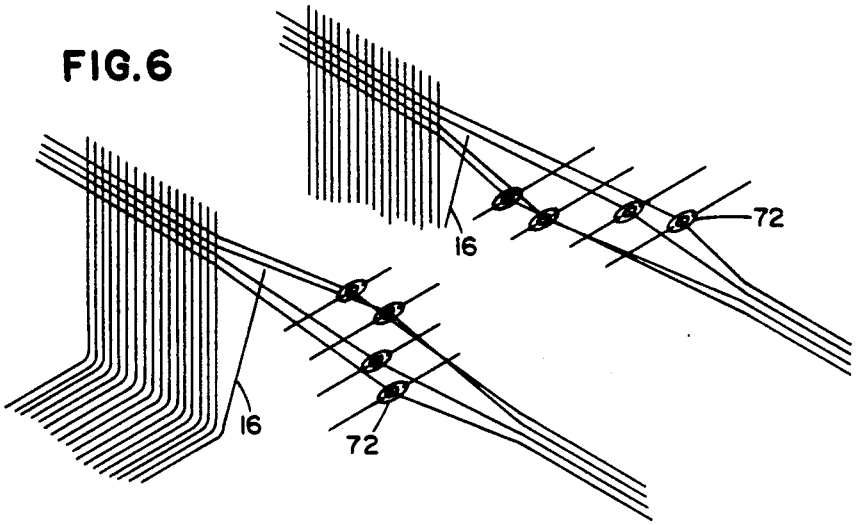
FIG.6

APPARATUS FOR SELECTIVELY RELEASING YARNS FROM A FRINGE

BACKGROUND OF THE INVENTION

1. Field of the Invention

The present invention relates to an apparatus for use in production of a woven seam in fabric belts. More particularly, the present invention relates to an apparatus for automatically forming a woven seam in industrial fabrics of the type employed in the papermaking industry. The present apparatus is especially useful in automated seaming of papermakers fabrics used in the Fourdrinier or forming section of a paper machine.

2. Background of the Art

The art has recognized for some time the advantages to be achieved through the seaming of flat woven fabrics to render them endless, in the manner of a circular or endless woven fabric. Most recently, the art has recognized the advantages to be achieved by the use of automated equipment to weave the seam which renders a flat woven fabric endless. Two prior art attempts to economically accomplish such automated seaming are disclosed in U.S. Pat. Nos. 4,410,015 and 4,581,794. U.S. Pat. No. 4,581,794 is commonly assigned with the present invention to Asten Group, Inc. Notwithstanding the aforementioned attempts, a majority of the seaming is still accomplished by a semi-automated hand weaving operation.

A major concern of the prior art, both automatic and semi-automatic, has been the ability to select, separate, present and interweave individual threads in the proper order during seam formation. As will be recognized by those skilled in the art, it is preferred that the weave pattern in the seam area be consistent with the weave throughout the remainder of the fabric. With very simple fabrics, such as a single layer plain weave, the problem is not so acute. However, in multi-layered fabrics having more complex weaves, the problems associated with separating the proper yarn in accordance with the weave sequence is more acute.

For some time, the art has sought solutions to the problems of selecting the yarn, separating the yarn and presenting the yarn for interweaving. The present invention meets all three of these objectives.

SUMMARY OF THE INVENTION

The present invention provides an apparatus for selectively releasing tied yarns from a fringe strip. The fringe strip is comprised of a plurality of tying and tied yarns which are interwoven in a given repeat pattern.

The apparatus utilizes a shed formation means to define a shedding pattern for the fringe strip tying yarns. Through the operation of the shedding means, it is possible to manipulate the tying yarns of the fringe to selectively release a tied yarn from the strip. The manipulation of the tying yarns is accomplished through a plurality of individual control means. As an individual tied yarn is released from the fringe strip, it is separated and presented for interweaving in the seam area. The weaving process may be a hand weaving process or one of the automated weaving process as described in the U.S. Pat. Nos. 4,410,015 or 4,581,794.

BRIEF DESCRIPTION OF THE DRAWINGS

FIG. 4 illustrates the yarn threading arrangement from the left hand side of the apparatus.

FIG. 5 illustrates the yarn threading arrangement from the right side of the apparatus.

FIG. 6 illustrates the shedding of the fringe and the release of a tied yarn.

DESCRIPTION OF THE PREFERRED EMBODIMENT

As noted previously, the present invention is suitable for use in the apparatus described in U.S. Pat. No. 4,581,794. Accordingly, this disclosure will be limited to a discussion of separating yarns from the fringe. For discussion of actual interweaving, reference should be made to U.S. Pat. No. 4,581,794 which is incorporated herein for that disclosure as if fully set forth.

Figure 1:
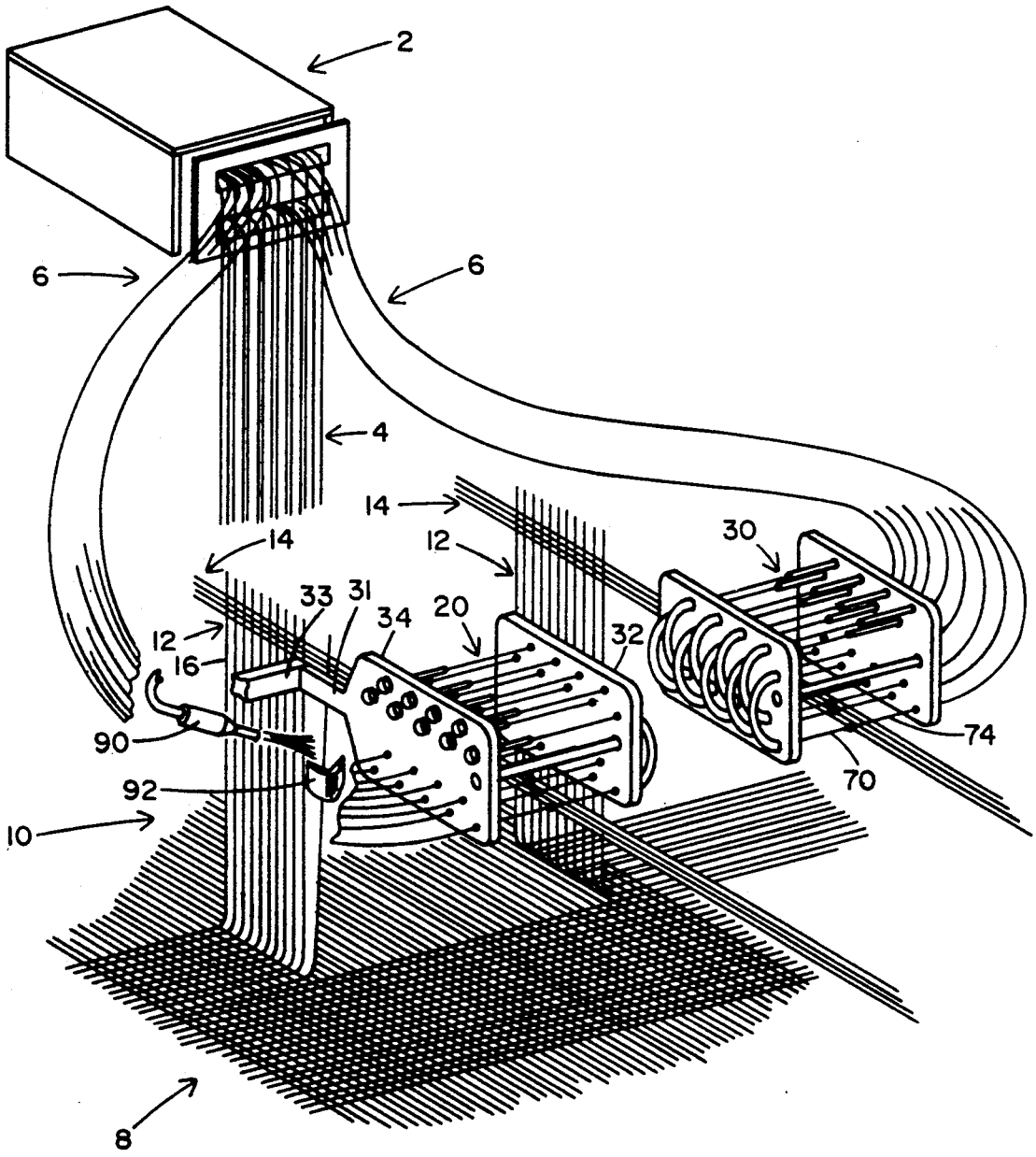
FIG. 1 is a perspective view of an apparatus in accordance with the present invention.

With reference to FIG. 1, there is shown a Jacquard machine 2 and a fabric 8 which is to be seamed. A plurality of harness cords extend from the Jacquard machine 2. The central group of harness cords 4 extend downwardly from the Jacquard machine 2 to the fabric 8 which is being seamed. The harness cords 4 will control the shedding of yarns 10 in the base fabric 8 as the selected fringe yarn 16 is interwoven as part of the seam. In addition to the central group of harness cords 4, there are two sets of side cords 6. Each set of the side cords 6 is assigned a respective left and right hand position. The side cords 6 extend from the Jacquard machine 2 to the respective fringe control apparatus 30 and will control the shedding of the ribbon of tying fringe yarns 14 during selective release of the tied fringe yarns 16. In their interwoven state, the tying yarns 14 and the tied yarns 16 form a fringe area 12. Since the left and right hand fringe control apparatus 20 and 30 are essentially mirror images of each other, the description thereof will be limited to one fringe control apparatus. To the extent that there are distinctions between the left and right hand sides, they will be clearly identified and described hereinafter.

Figure 2:
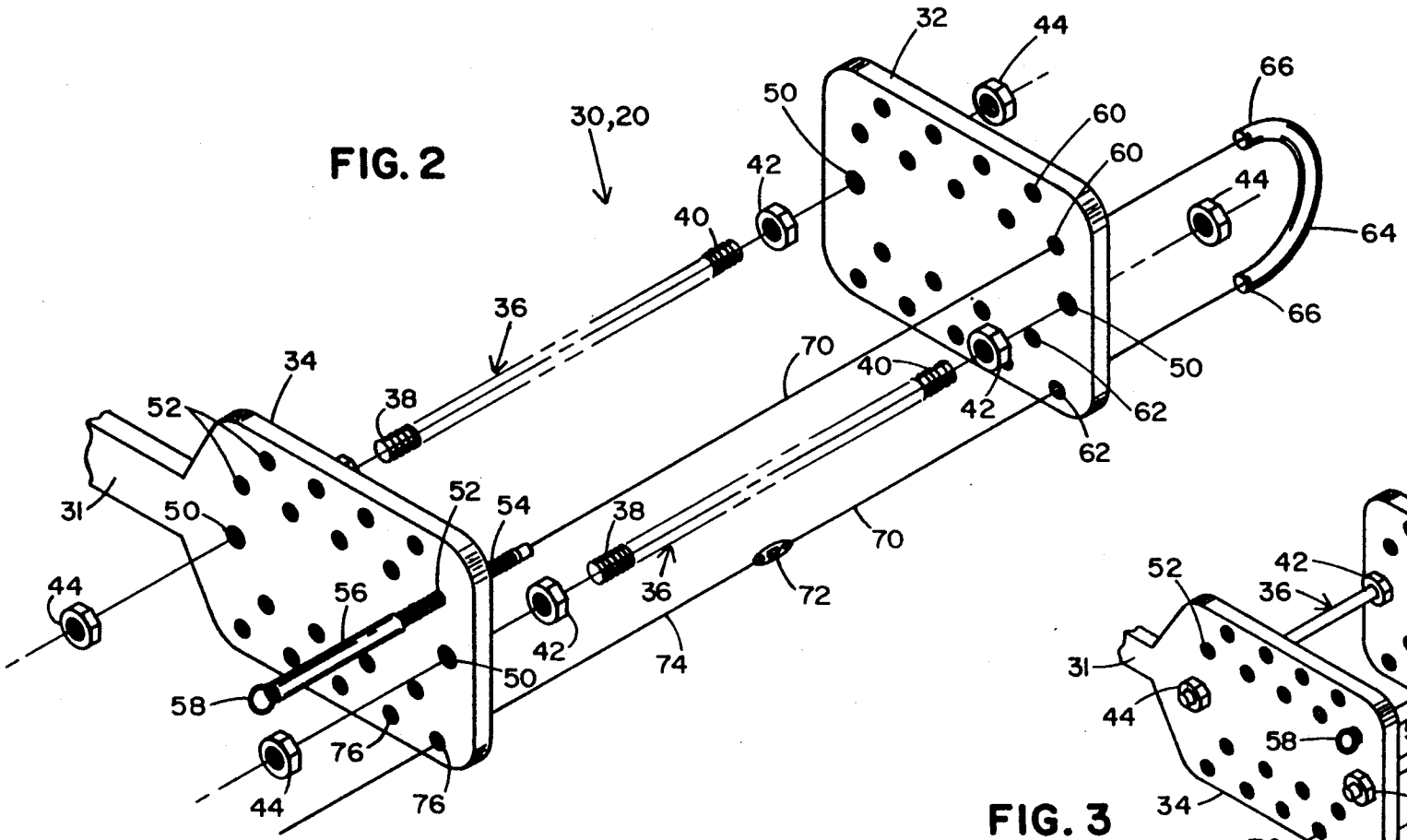
FIG. 2 is an exploded view of a yarn shedding means in accordance with the present invention.

Turning now to FIG. 2, the preferred fringe control apparatus 20 as it appears on the left hand side of FIG. 1 will be described in more detail. Each fringe control apparatus 20 is comprised of opposed mounting plates 32 and 34 which are spaced apart and oriented in parallel vertical planes. The distance between the mounting plates 32 and 34 is maintained by the spacing shafts 36. Each shaft 36 has an unthreaded central portion and threaded end portions 38 and 40. A nut 42 is secured to each shaft at the threaded portions 38 and 40. The nut is threaded toward the central portion and the threaded portion is then passed through the respective plate 32 or 34 at the apertures 50 and a second nut 44 secured thereto. As a result of this arrangement, it is possible to adjust the spacing between the mounting plates. While the preferred embodiment has been shown with two spacers 36, it will be understood by those skilled in the art that additional spacers may be used and the final number will depend upon the structural rigidity desired for the fringe control apparatus 20.

Mounting plates 32 and 34 have a series of apertures formed across their upper and lower portions. With reference to mounting plate 34, the upper series of apertures 52 is dimensioned to securely receive the brass sleeve 56. Within brass sleeve 56 is a spring element 54. Each spring element 54 is retained within a respective sleeve 56 and aperture 52 by a ring 58. The opposed plate 32 has a plurality of apertures 60 which generally correspond to the apertures 52. Each aperture in the second series of apertures 62 in plate 32 is generally in vertical alignment with a corresponding aperture 60 and is substantially the same size. The apertures 60 and 62 are slightly tapered or chamfered, in the manner of a recess, as they extend through the plate 32 toward the plate 34. A semi-circular sleeve 64, with tapered ends 66, is fitted vertically between the respectively paired apertures 60 and 62. Sleeve 64 provides a raceway and turnaround for the control cord 70 as it extends between spring 54 and the mail or eyelet 72. Control cord 74 extends from the left side of eyelet 72 through the aperture 76 to the associated harness cord of side cords 6 on the left side of the Jacquard machine 2. As will be appreciated by those skilled in the art, the aperture 76 is dimensioned to accommodate cord 74. In addition, it is preferred that each aperture 76 be provided with an eyelet to reduce abrasion on the cord 74.

Figure 3:
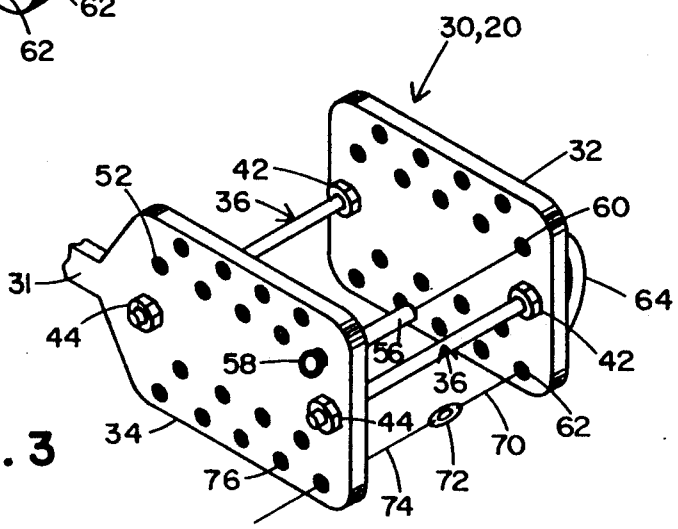
FIG. 3 is an assembled view of the yarn shedding means depicted in FIG. 2.

FIG. 3 shows the elements of FIG. 2 assembled. As can be seen with reference to FIGS. 1, 2 and 3, the fringe control mechanism is adaptable in size and, therefore, can be varied to accommodate varied shed counts. With reference again to FIGS. 1 and 2, it can be seen that plate 34 is provided with an extending arm member 31. The extending arm 31 is secured to a horizontal mounting member 33 which is securely mounted and positioned so as to locate the fringe control apparatus 20 adjacent to the fringe. In the preferred embodiment, the mount 33 is connected directly to the base of the automatic seaming apparatus. It will be understood by those skilled in the art that the variety of seaming devices presently used in the art will result in differential mounting techniques in order to avoid interference with movement of the fabric or seaming.

One of the advantages to the present invention is the fact that the carding arrangement for the Jacquard machine 2 may possess the same repeat pattern for controlling the harnesses 4 and 6. Alternatively, the repeats for the fringe harnesses 6 are the same as each other but different than that of harness 4. Stated in another way, the cards for harnesses 6 have the same repeat pattern without regard to whether or not harnesses 4 or 6 are being controlled by same card arrangement. In order to facilitate this arrangement, the tying yarns 14 are inverted as they are led into the fringe control apparatus in the respective right and left hand positions. This is explained in more detail below.

FIG. 4 will be representative of the right side apparatus 30 and FIG. 5 will representative of the left side apparatus 20. If we assume that the fabric is woven in an eight shed repeat, the ribbon of tying yarns 14 would preferably be comprised of two repeats or sixteen yarns. Accordingly, the tying yarns 14 are represented as 14-1 through 14-16. The yarns of the left side are sequenced opposite to those of the right side. With reference to FIG. 4, the first tying yarn 14-1 will be controlled by the mail 72 occupying the number 1 position in the lower right hand corner of plate 32. After yarn 14-1 has passed beyond the controlled apparatus 30, it is strung through an end ribbon control bracket 80. The sequence of holes in end ribbon control bracket 80 is the same as that in the associated bracket 32. As will be understood by those skilled in the art, each yarn 14, after it proceeds through the bracket 80, is weighted to maintain the proper tension in accordance with accepted Jacquard techniques.

With reference to FIGS. 4 and 5, it can be seen from a comparison of the two figures that the yarn designations and their positions have been reversed or inverted. Accordingly, in FIG. 5 the lower right hand position is designated 16, as opposed to its previous designation as 1, and will receive the yarn 14-16. As described above, the yarn 14-16 continues through the ribbon control bracket 80 and is weighted.

As can be seen from a comparison of FIGS. 4 and 5, the respective yarns 14-1 through 14-16 occupy the same relative position in their respective ribbon 14 and plate 32. It is at this point that the lacing of the harness cords 6 becomes relevant. The respective harness cord 6 from each side of the Jacquard machine is laced with the respective tying yarn of ribbon 14 in accordance with the weave repeat pattern. In our example of an eight shed, positions 1 through 8 on each side of the Jacquard machine 2 would be connected to the respective positions 1 through 8 on the respective plate 32. The second repeat, 9 through 16, would be connected in a like manner.

By reference to FIGS. 5 and 6, the result of operating the Jacquard machine under the above described control is illustrated. As can be seen in these figures, the ribbon 14 is manipulated or shedded in the mirror image of itself. As a result of this mirror image shedding, the proper tied yarn 16 is sequentially released from the tying yarns of the ribbon 14 and is made available for interweaving. With reference to FIG. 1, the preferred embodiment includes a pulsed air or pressure source 90 and a yarn catcher 92 to assist in liberation and capture of the tied yarn 16. As the yarn is released from the tying ribbon 14, it is preferred that a controlled burst of air be released from the pressure source 90 to direct the yarn into the yarn catcher 92. The catcher 92 momentarily stabilizes the yarn and assists in determining a fixed position for pick up of the yarn 16 as part of the interweaving process to complete the seam construction.

Figure 7:
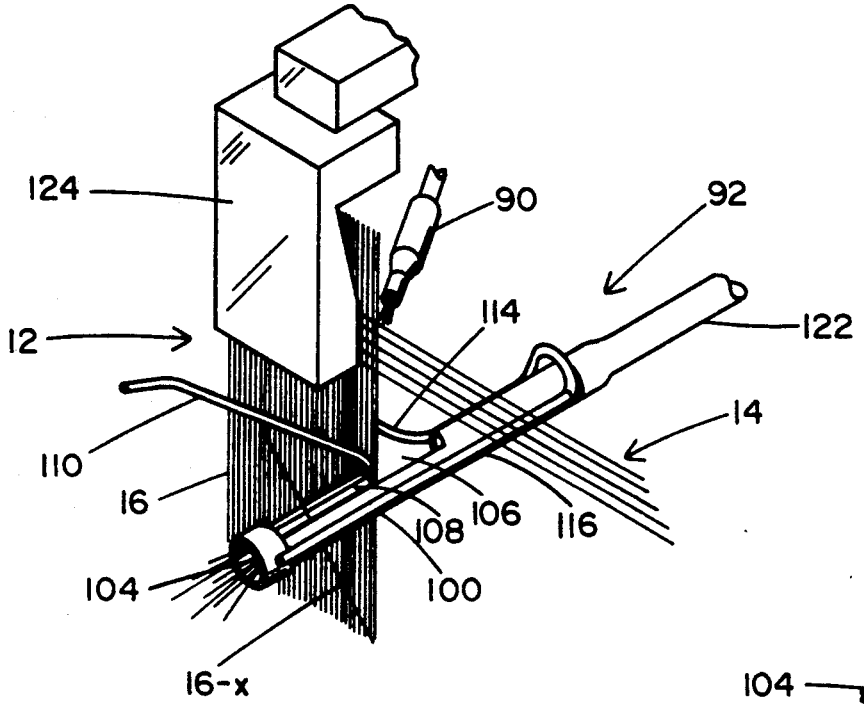
FIG. 7 illustrates a preferred means for capturing a yarn prior to interweaving.
Figure 9:
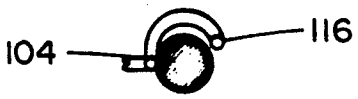
FIG. 9 is a side elevation taken in the direction of 9—9 on FIG. 8.
Figure 8:
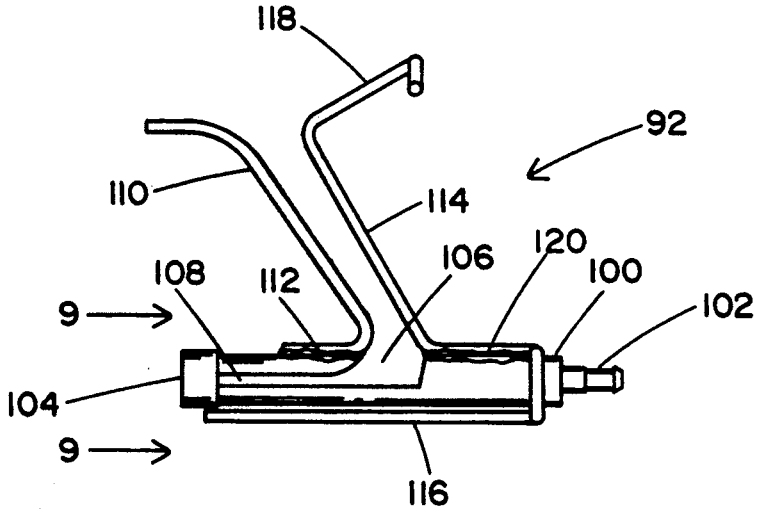
FIG. 8 illustrates a preferred capture device.

With reference to FIGS. 7, 8 and 9, a preferred location for the pressure source 90 and a preferred construction for the yarn capture 92 will be described in more detail.

With reference to FIG. 7, the pressure source 90 is preferably positioned to the inside of the yarn fringe at about the point where separation will take place. Preferably, the pressure source 90 will direct the air outwardly so that the air is expelled away from the fringe yarns and the seam area. In the preferred embodiment, the yarn catcher 92 is secured to the guide-mount 124. The guide 124 will assist in securing and positioning the free end of the fringe 12. Although principle control over the fringe 12 will be established through the ribbon 14, guide 124 has been found to be useful. Since guide 124 is positioned adjacent the seam area, it makes an ideal mount for the yarn catcher 92. As a tied yarn 16 is released, it will fall into the side opening 106 and will be blown into the slot 108. This operation can be clearly understood by reference to FIG. 8.

With reference to FIG. 8, the yarn catcher 92 has a tubular body 100 which is approximately two inches in length. Tubular body 100 is closed at one end by the nipple 102; the other end 104 is open. Opening 106 in the side of tubular body 100 is approximately 0.375 inches long and communicates with slot 108 which is approximately 0.75 inches long. The open side 106 is bordered by guides 110 and 114. As can be seen by reference to FIG. 7, the guides 110 and 114 will extend about tied yarns 16 of fringe area 12.

Returning to FIG. 8, an additional guide 116 is provided. Guide 116 extends parallel to the open side 106 and the slot 108 and is positioned off of the body 100 by approximately 0.125 inches. Guide 116 is about 1.875 inches long and serves a bearing for a tied yarn 16 as it is released from the fringe area 12. As can be appreciated by those skilled in the art, the released yarn will be of such a length that a portion of the free end of the yarn may extend past the body 100. In the event that the yarn rolls over the body 100, guide 116 will assure that the yarn does not become abraded in the side opening or slot. Yarn catcher 92 also has a mounting arm or stem 118 which is used to secure catcher 92 to guide-mount 124. In the preferred embodiment, guide 110 is secured to the body 100 by weldment 112. The guides 114 and 116 and the mounting arm 118 are formed from a single piece of stock which is secured to the body 100 by the weldment 120.

When tied yarn 16 is released from the tying yarns 14, it will naturally fall forward toward side opening 106 and also be urged forward by an air jet from pressure source 90. The yarn 16 will proceed through the guides and into the side opening 106. At this time, a current of air from line 122 is passed through the hollow tubular body 100. As the air passes through body 100 it will urge the released yarn 16 toward the end 104. Since the end 104 is open, the air will continue through the tube without the creation of back currents against the yarn 16. At this point, the yarn 16 has been accurately positioned and may be picked up by the weaving apparatus for interweaving into the seam of the fabric 8.

Figure 10:
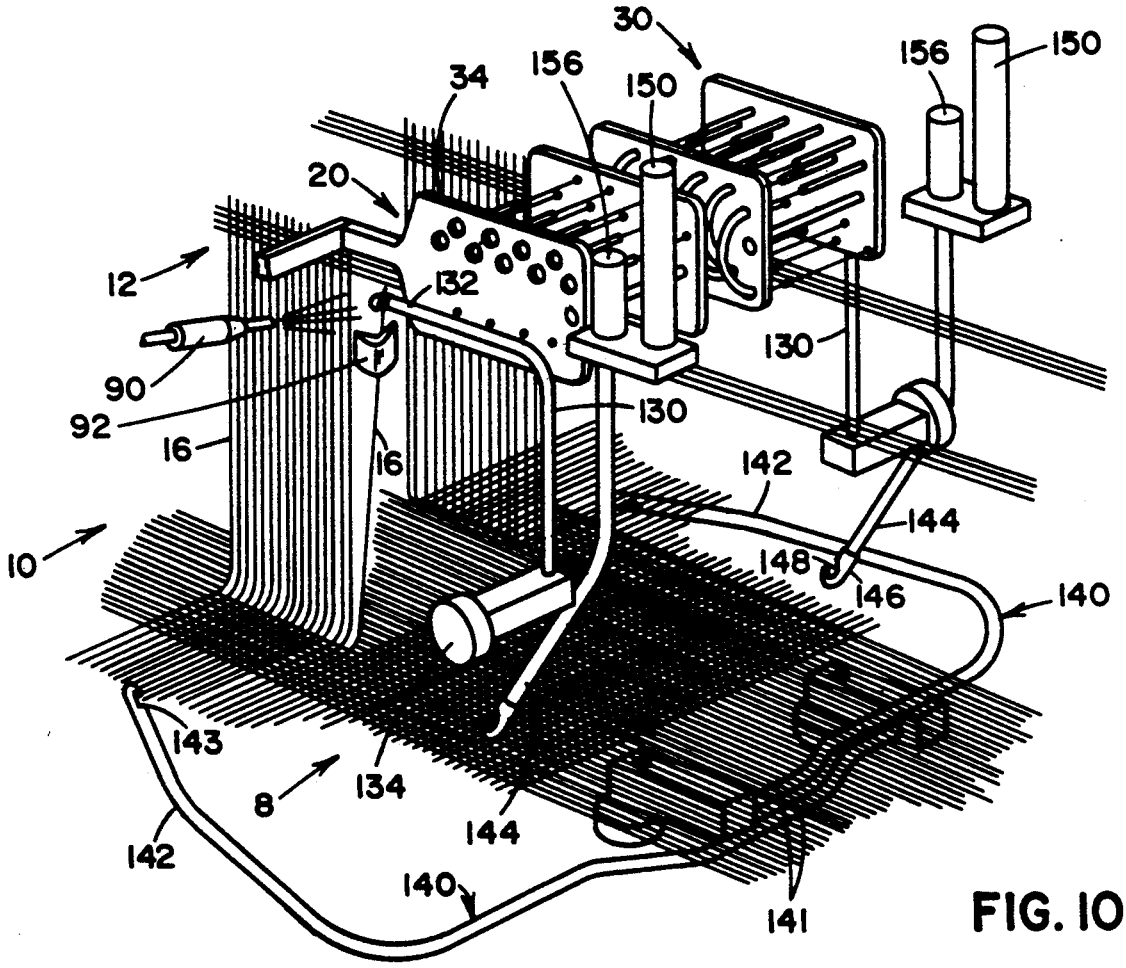
FIG. 10 illustrates the present invention in an automated seaming apparatus.
Figure 11:
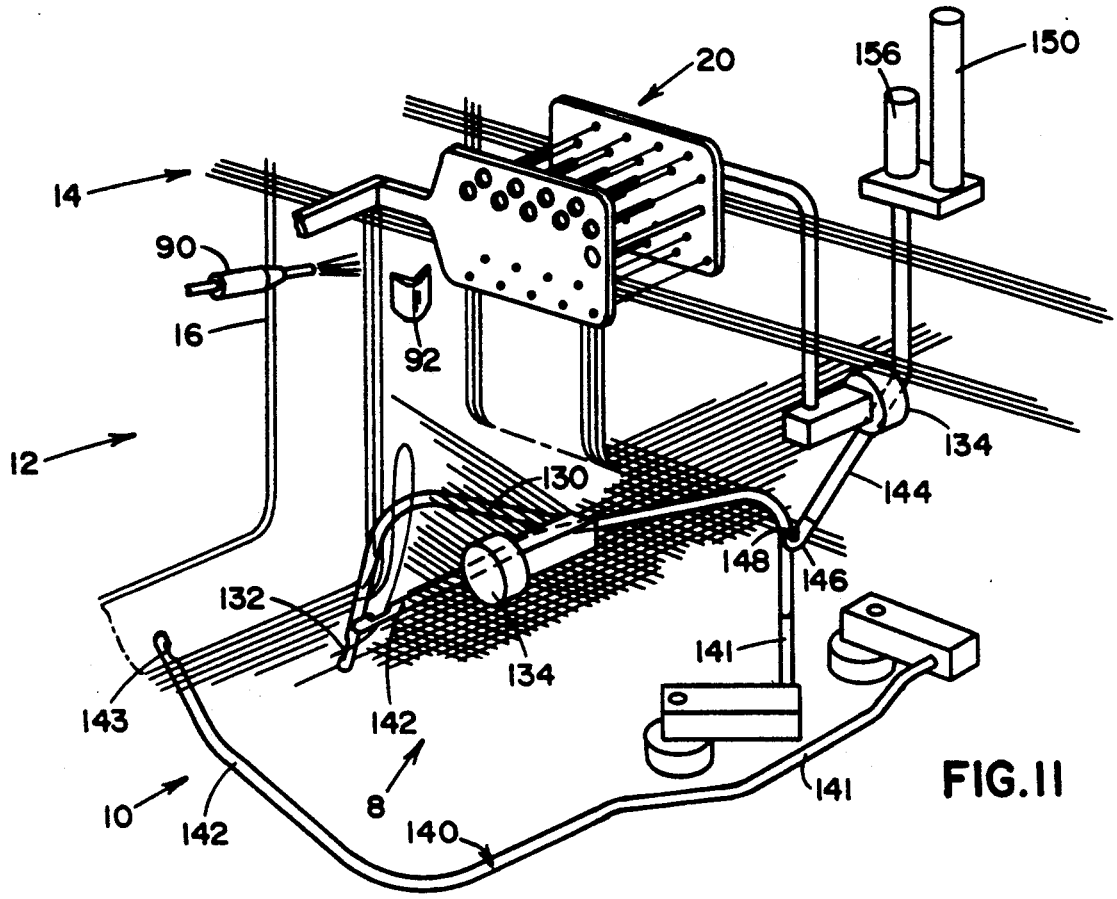
FIG. 11 illustrates the interweaving of a yarn after it has been released from the separator to the automated weaving apparatus.
Figure 12:
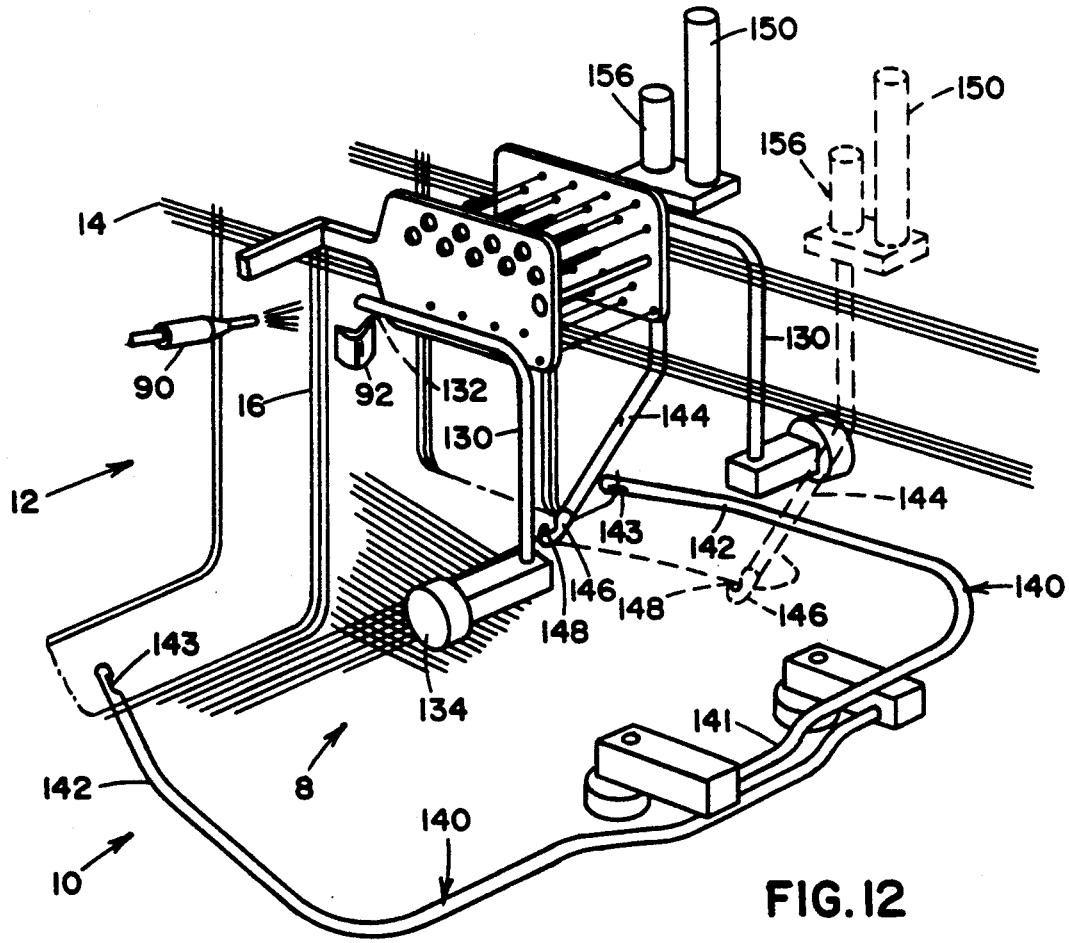
FIG. 12 illustrates the interweaving of the released yarn.

FIGS. 10, 11 and 12 illustrate the present invention in an interweaving apparatus as disclosed in U.S. Pat. No. 4,581,794. The separation means of the present invention has been described herein above and reference should be made to U.S. Pat. No. 4,581,794 for a full description of the interweaving apparatus. The following description generally describes the interweaving of a separated yarn. As shown in FIG. 10, the selected fringe yarn 16 will first come under the influence of a transfer arm 130. A pair of transfer arms 130 are positioned on either side of the seam. Each transfer arm is supported for pivotal movement about a horizontal axis parallel to the fabric 8. The free end 132 of each transfer arm 130 includes a means for gripping the selected fringe yarn 16 following the separation. The free end 132 of the transfer arm 130 is positionable so that it can grip the selected fringe yarn 16 and then move the yarn to the position shown in FIG. 11.

With reference to FIG. 11, the selected fringe yarn 16 is moved generally forward and downward so that the free end of the yarn is moved into the shed plane of the fabric 8. At this time, the yarn will come under the influence of an interlacing arm 140. There are a pair of interlacing arms 140 which are disposed on either side of the fabric seam. The interlacing arms 140 are disposed so as to rotate over the seam area and through the shed formed by the shedding of yarns 10 in the base fabric. The selected fringe yarn 16 will be transferred from the free end 132 of a transfer arm to the free end 142 of the interlacing arm. The free end 142 of interlacing arm 140 includes means for gripping the thread in the yarn receiving notch 143 when it is transferred from end 132. Each of the interlacing arms 140 is generally L-shaped and is supported at the end 141 for pivotal movement about a vertical axis. In this manner, the interlacing arms 140 will generally move in a horizontal plane from one side of the fabric seam through the shed opening to an opposite side of the fabric seam. In this manner, the selected yarn 16 is pulled across the shed and is interwoven in the repeat pattern. Compare FIGS. 11 and 12. With reference again to FIGS. 10, 11 and 12 the interwoven yarn is then transferred from the interlacing arm to an extractor arm 144. Once again, there are a pair of extractor arms which are positioned on either side of the seam. Each extractor arm is provided with means for causing selected vertical movement of the lower end 146 of extractor arm 144. In one form of the apparatus, the means for selected vertical movement comprises a pair of pneumatically controlled pistons which are contained within piston housings 150 and 156. As the selected yarn 16 is brought across the fabric seam face, as shown in FIG. 12, it will come under the influence of the extractor arm 144. Once again, the extractor arm is provided with means within yarn receiving notch 148 for gripping the yarn as it is released from the interlacing arm 140. Having thus gained control over the yarn, the yarn is pulled against the face of the seam by rearward retraction of the extractor arm 144, see FIG. 12.

What I claim is:

1. An apparatus for selectively releasing tied yarns from a fringe comprised of a plurality of tying yarns which are arranged in a given pattern with the tied yarns, said apparatus comprised of:

shed formation means for defining a shedding pattern;

a plurality of yarn manipulation means, at least equal in number to said tying yarns, each of said yarn manipulation means being associated with a respective tying yarn and controlled by the shed formation means; and mounting means for securing the yarn manipulation means in a predetermined order and position with respect to the fringe, whereby the tying yarns are manipulated according to the shedding pattern and tied yarns are released from the tying strip.

2. The apparatus of claim 1 wherein said shed formation means is a Jacquard head.

3. The apparatus of claim 1 wherein each of said yarn manipulation means is a mail eye.

4. The apparatus of claim 1 wherein the tied yarns are selected individually for release from the tying strip.

5. The apparatus of claim 1 wherein said apparatus further comprises non-contact means for urging the selected individual tied yarn away from the remaining tied yarns.

6. The apparatus of claim 1 wherein the apparatus further comprises means for urging the selected yarns away from the remaining tied yarns.

7. The apparatus of claim 6 wherein the means for urging the selected yarns away from the remaining tied yarns is a fluid means.

8. The apparatus of claim 7 wherein said fluid means is a pneumatic means.

9. The apparatus of claim 1 wherein the shedding pattern defined by said shed formation means is the mirror image of the given pattern in which the tying and tied yarns are arranged.

10. An apparatus for joining the opposite ends of a length of woven fabric into an endless woven fabric belt by means of a woven seam, each of said opposite ends having a warp fringe with tying yarns which are arranged in a given pattern with the warp yarns of the fringe, said apparatus comprising:

a) means for supporting the opposite ends of the fabric in closely spaced relation on opposite sides of a strip of weft threads;

b) means for supporting the weft threads between the opposite ends of the fabric and to position the weft threads for interweaving with the warp yarns of the fringe;

c) means for selectively releasing warp yarns from the fringe, said means comprised of:

shed formation means for defining a shedding pattern;

mounting means positioned adjacent to the fringe of warp yarns; and a plurality of yarn manipulation means, at least equal in number to said tying yarns, each of said yarn manipulation means associated with a respective tying yarn and controlled by the shed formation means; whereby the tying yarns are manipulated according to the shedding pattern and warp yarns are released from the fringe; and, d) means for interweaving the released warp yarns with the weft threads.

11. An apparatus for selectively releasing tied yarns from a ribbon of tying yarns which are arranged in a given pattern with the tied yarns, said apparatus comprised of:

shed formation means for defining a shedding pattern;

a plurality of yarn manipulation means associated with the tying yarns and controlled by the shed formation means; and means for securing the yarn manipulation means in a predetermined order and position with respect to the ribbon, whereby tying yarns are manipulated according to the shedding pattern and tied yarns are selectively released.

12. The apparatus of claim 11 wherein said shed formation means is a Jacquard means.

13. The apparatus of claim 11 wherein each of said yarn manipulation means is a mail eye.

14. The apparatus of claim 1 wherein the tied yarns are selected individually for release.

15. The apparatus of claim 11 wherein said apparatus further comprises non-contact means for urging a selected tied yarn away from the remaining tied yarns.

16. The apparatus of claim 15 wherein the apparatus further comprises a yarn catching means.

17. The apparatus of claim 16 wherein the means for urging the selected yarns away from the remaining tied yarns is a fluid means.

18. The apparatus of claim 17 wherein said fluid means is a pneumatic means.

19. The apparatus of claim 11 wherein the shedding pattern defined by said shed formation means is the mirror image of the given pattern in which the tying and tied yarns are arranged.

20. The apparatus of claim 11 wherein the apparatus is further comprised of a yarn catching means.

21. An apparatus for selectively releasing tied yarns from a fringe comprised of a plurality of tying yarns which are arranged in a given pattern with the tied yarns, said apparatus comprised of:

shed formation means for defining a shedding pattern;

horizontal mounting means having spaced apart opposed plates which are positioned adjacent to the fringe; and a plurality of yarn manipulation means, at least equal in number to said tying yarns, each of said yarn manipulation means is positioned between the opposed plates, is associated with a respective tying yarn and is controlled by the shed formation means, whereby the tying yarns are manipulated according to the shedding pattern and selected tied yarns are released from the tying strip.

22. The apparatus of claim 21 wherein said shed formation means is a Jacquard means.

23. The apparatus of claim 21 wherein each of said yarn manipulation means is a mail eye.

24. The apparatus of claim 21 wherein the tied yarns are selected individually for release from the tying strip.

25. The apparatus of claim 24 wherein said apparatus further comprises non-contacting means for urging the selected individual tied yarn away from the remaining tied yarns.

26. The apparatus of claim 21 wherein the apparatus further comprises means for urging the selected yarns away from the remaining tied yarns.

27. The apparatus of claim 26 wherein the means for urging the selected yarns away from the remaining tied yarns is a fluid means.

28. The apparatus of claim 27 wherein said fluid means is a pneumatic means.

29. The apparatus of claim 21 wherein the shedding pattern defined by said shed formation means is the mirror image of the given pattern in which the tying and tied yarns are arranged.

30. An apparatus for joining the opposite ends of a length of woven fabric into an endless woven fabric belt by means of a woven seam, each of said opposite ends having a warp fringe with tying yarns which are arranged in a given pattern with the warp yarns of the fringe, said apparatus comprising:

a) means for supporting the opposite ends of the fabric in closely spaced relation on opposite sides of a strip of weft threads;

b) means for supporting and positioning the weft threads between the opposite ends of the fabric for interweaving with the warp threads of the fringe;

c) means for selectively releasing warp threads from the fringe, said means comprised of:

i) shed formation means for defining a shedding pattern;

ii) a plurality of thread manipulation means associated with the warp threads and controlled by the shed formation means;

iii) mounting means for securing the thread manipulation means in a predetermined order and position with respect to the warp threads; and d) means for interweaving selectively released warp threads with the weft threads.

31. An apparatus for selectively releasing tied yarns from a tying strip comprised of a plurality of yarns which are arranged in a given pattern with the tied yarns, said apparatus comprised of:

shed formation means for defining a pattern of shedding the tying yarns;

mounting means having spaced apart, opposed mounting plates which are positioned adjacent to the tying yarns; and a plurality of yarn manipulation means, each yarn manipulation means being mounted between the opposed plates, associated with the tying yarns in a predetermined order and controlled by the shed formation means;

whereby the plurality of yarns in the tying strip are manipulated according to the shedding pattern and the tied yarns are selectively released from the tying strip.

* * * * *